United States Patent [19]

Karlsson

[11] 4,233,007

[45] Nov. 11, 1980

[54] APPARATUS FOR POWDER MANUFACTURE BY ATOMIZING A MOLTEN MATERIAL

[75] Inventor: Stig A. Karlsson, Tierp, Sweden

[73] Assignee: Uddeholms Aktiebolag, Hagfors, Sweden

[21] Appl. No.: 641,522

[22] Filed: Dec. 17, 1975

[30] Foreign Application Priority Data

Dec. 18, 1974 [SE] Sweden ..... 7415957

[51] Int. Cl.[3] ..... B22D 23/08

[52] U.S. Cl. ..... 425/7; 264/12

[58] Field of Search ..... 425/7; 264/12; 65/7, 65/16; 222/594, 603; 23/273S P; 75/0.5 B

[56] References Cited

U.S. PATENT DOCUMENTS

| | | | |
|---|---|---|---|
| 3,592,391 | 7/1971 | Bender et al. . | |
| 3,752,611 | 8/1973 | Reed et al. | 427/7 |
| 3,813,196 | 5/1974 | Bockstrom et al. | 425/7 |

FOREIGN PATENT DOCUMENTS

| | | | |
|---|---|---|---|
| 638581 | 6/1950 | United Kingdom | 427/7 |
| 712699 | 7/1954 | United Kingdom | 264/12 |

*Primary Examiner*—Mark Rosenbaum

*Attorney, Agent, or Firm*—Curtis, Morris & Safford

[57] ABSTRACT

The invention relates to an apparatus for atomizing a molten material, by disintegration of a stream of the molten material by fluid jets directed under high pressure against said stream, a first and a second fluid jet generated at opposite sides of the stream being converged towards a point of intersection lying aside of the stream of molten material, said first fluid jet being spread out in a plane intersecting the stream of molten material at an acute angle, said second fluid jet extending within ±10° relative to the original direction of the stream of molten metal. The invention is characterized in that said second fluid jet is imparted the shape of a curved curtain with its concave side facing the stream of molten material, and the second nozzle, in a plane perpendicular to the pouring direction, is curved with its concave side facing the casting opening and directed essentially in the same direction as said casting opening.

5 Claims, 3 Drawing Figures

APPARATUS FOR POWDER MANUFACTURE BY ATOMIZING A MOLTEN MATERIAL

The present invention relates to an apparatus for the manufacture of powder by atomizing molten material, in which a stream of molten material is atomized or broken up into fine drops when it is contacted by an atomizing agent, usually a fluid, which under high pressure is directed in the form of jets against the stream.

The requirements of a powdered or atomized product vary with the field of use. The basic properties of the powder are determined by its chemical composition, the shape of the powder particles, the distribution of particles of different size and the microstructure of the powder particles.

The apparatus according to the present invention is primarily intended to be used in the manufacture of powders of high-alloyed steel for producing compact steel by hot isostatic pressing of the powder, but may, of course, also be used in the manufacture of other types of powder. In the manufacture of such high-alloyed steel powder, the desired properties of the powder are determined by both the method to to used for sintering the powder and by the desired properties of the steel bodies to be manufactured from the powder. The principal desiderata with regard to the properties of the powder, apart from its content of alloying materials, may be summarized as:

(a) low oxygen content, i.e. the powder should not be oxidized on the surface (high-alloyed steel normally contains alloying materials forming very stable oxides which are difficult to reduce)

(b) spherically shaped particles with a smooth surface, i.e. without bubbles or cavities (c) correct size distribution (d) the finest possible microstructure.

The invention relates to processes of the type in which a stream of the molten metal is disintegrated by directing one or more jets of some suitable atomizing agent, usually a fluid, for example a gas or liquid or a mixture of a gas and a liquid, preferably under high pressure and at an acute angle, against the stream, so that the stream is split up into fine particles or drops which are collected after being cooled to such an extent that they have solidified and attained such a temperature at which there is no longer any risk that the metal particles thus formed stick together. In order to cool the metal drops sufficiently, arrangements have often been used in which the powder is collected in a liquid bath, in most cases consisting of water. However, if the atomizing agent or the cooling medium contains oxygen, the metal particles to become oxidized on the surface, and this method is therefore not suitable for manufacturing powder of substances which form oxides difficult to reduce.

A large number of differently shaped nozzles for supplying a disintegrating fluid to a stream of molten metal have been suggested and probably the type most often used is that which surrounds the stream of molten metal and which, either through an annular slit or through a number of periperally arranged nozzle-openings, supplies the disintegrating fluid in the form of one or more jets which converge conically towards the stream of molten metal at one or more points.

The present invention relates to an advantageous process for atomizing a molten metal to a fined powder of extremely high quality. The invention also covers a special design of the nozzles through which a disintegrating medium is directed against a stream of molten metal to atomize same.

On studying various ways for the production of metal particles with the help of disintegrating fluid which, in the form of narrow jets, is directed against a stream of molten metal symmetrically from at least two sides and at an acute angle to the stream of metal, it has been found that it is almost impossible to avoid the metal being thrown to a greater or lesser extent to one side and slightly upwards. It has also been established that this throwing or twisting of the stream of molten metal during the actual atomizing process is detrimental to the process of breaking up the stream of metal into the fine drops required in order to achieve a uniform, fine-grained powder. It is clear that this twisting of the metal stream is caused because it cannot be made to meet the fluid jets exactly at their point of intersection. Instead, the metal stream meets one or the other of the fluid jets immediately before they meet each other.

Because of the metal particles which splash around during atomization of a stream of molten metal, substantially directed against the intersection point of the fluid jets, the angle between the fluid jets and the metal stream must be kept relatively small preferably between 20° and 30°. There is otherwise a risk of the metal being thrown back towards the fluid nozzles and clogging them, or of the metal particles splashing around disturbing the fluid jets in some other way. This is a serious disadvantage, since a large angle between the metal stream and the fluid jets has been found to have a favourable influence on the size and uniformity of the particules.

In accordance with the technique described in U.S. Pat. No. 3,813,196 and assigned to the same assignee of the present disclosure, the result of atomization can be considerably improved if a stream of molten metal, while it is still a substantially coherent stream, is deflected by a first fluid jet which forces the metal to alter direction and follow the direction of the jet at the same time as it spreads out the metal to a thin layer floating substantially on top of the fluid jet, and this first fluid jet and the metal resting on top are intersected by a second fluid jet at a distance from the point of intersection between the stream of molten metal and the first fluid jet sufficient to permit the change in direction and spreading out of the metal to be substantially complete, the second fluid jet splitting up the metal into a shower of fine particles. It is probable that most of the desired disintegration into free drops or particles takes place already at the meeting point between the stream of molten metal and the first fluid jet, when the original shape and direction of the stream is altered and the stream receives kinetic energy from the fluid jet. This kinetic energy is converted partly into a surface energy, whereby the metal stream is at least partially dispersed into dropw which are accelerated so that they are split. Another conversion of kinetic energy to surface energy takes place in the meeting point with the second fluid jet, whereby the molten metal and the drops already formed are further subdivided. The second fluid jet also has the important function that it spreads out the particles as a uniform shower of fine metal particles which facilitates the cooling of the granules. Since one purpose of the first fluid jet is to spread out the stream of molten metal to a thin layer, wider than the original stream, the first fluid jet must be considerably wider than the metal stream, The widening of the metal stream means that the second fluid jet must be still wider than the first one. The second jet must always be wider than the spread stream of metal. In order to make certain that the stream of molten metal changes direction and spreads itself on top of the first fluid jet at its intersection therewith, the shortest distance from this intersection to the intersection with the second fluid jet must not be less than twice the greatest width (diameter) of the metal stream measured immediately before the intersection with the first fluid jet. If the distance between these intersection points is too short, the result will be about the same as with atomizing means of the type previously described in which the metal stream is intended to cut the two fluid jets at their point of intersection, but because of poor centering, it meets one of the fluid jets adjacent to the point of intersection of the two jets. Such poor centering causes a great deal of metal particles to splash about.

When atomizing in accordance with the disclosure of the above-identified U.S. Pat. No. 3,813,196, in which the molten metal is caused to change direction at two distinct deflection points, the best result is achieved if fluid jets are used which have a width which is considerably greater than their thickness. Such fluid jets are obtained by means of slit nozzles arranged on opposite sides of the metal stream and extending substantially parallel to each other, the jets from them being directed at an angle to the metal stream. The distance between the deflection points should not be so great than the molten metal has time to solidify before the final disintegration takes place, when the layer of molten metal is deflected by the second fluid jet. Of course, such drops that have already acquired the desired size on contact with the first fluid jet can be allowed to solidify before they come into contact with the second fluid jet, but in general it is probably suitable that all the material to be atomized is in liquid state when it reaches the second fluid jet. For this reason the longest distance between the intersection points of the fluid jets with the molten metal should generally not exceed 20 times the greatest width of the metal stream measured immediately before its intersection with the first fluid jet.

Even if the known technique described above has been found to operate in a principally satisfactory manner it is, however, subject to certain deficiencies. Thus, it is difficult to adjust the slit nozzles to obtain optimum results and in operation the system is sensitive to unavoidable variations in the operational parameters. The object of the present invention is to provide an apparatus whereby said inconventiences are eliminated.

In accordance with this invention it has surprisingly been found that if the straight slit nozzle for the second fluid jet in the technique of the mentioned U.S. Pat. No. 3,813,196 is replaced by a nozzle with a slit that is curved in a plane perpendicular to the direction of the stream of molten metal, the concave side of the slit facing inwardly towards said stream, essential advantages are gained with regard to operational reliability as well as yield of product. In a preferred embodiment of the process and the apparatus according to this invention the slit has a curvature corresponding to a part of a circular arc the center of the circular arc suitably essentially coinciding with the original center line of the stream of molten metal. The curved slit extends suitably over a sector of at least about 120°, and it is preferred to use a slit which is substantially semicircular, i.e. corresponding to a sector of about 180°.

As previously indicated the use of the technique according to the present invention means that the apparatus is less sensitive to unavoidable operational variations, for instance regarding the mounting of the nozzle stones that form the taphole. Furthermore it has been surprisingly found that the yield of granulated powder can be essentially increased, for instance from about 90 to about 98% which, of course, is an essential advantage.

In the process according to this invention it is possible to use angles between the stream of molten metal and the first fluid jet of up to 60°. The first fluid jet should form an angle of 30°-60°, preferably about 40°-45°, with the stream, whereas the angle between the first and the second fluid jet should be 25°-60°. It is further suitable that the second fluid jet does not form an angle of more than ±10° to the original stream of molten metal. The angles are calculated between the center lines or planes of jets having the same main direction. It has been found particularly suitable if the second fluid jet is substantially parallel to the original direction of the metal stream, whereas the first fluid jet forms an angle of 40°-45° with the metal stream. The mentioned negative angle range between the second fluid jet and the stream of molten metal are usually not as advantageous as the direction parallel with the metal stream or the mentioned positive angle range. A negative angle results in a longer distance between the intersection point with the metal stream and the outlet of the nozzle, which causes the fluid jet to lose much of its original kinetic energy.

In the process described above for atomizing it is important that the fluid jets should be as distinct and coherent as possible and that the distance between the nozzles for the atomizing fluid, which is preferably a non-oxidizing gas, i.e., one that is non-reactive under the prevailing conditions, for instance argon or nitrogen, and the molten metal is as short as possible, in order that the fluid should have as much kinetic energy as possible. The width and the thickness of the fluid jets, as well as their speed and volume can be varied by altering the thickness and width of the nozzle outlets and by regulating the gas pressure in the nozzles. Also the width of the stream of molten metal can be varied within certain limits. By means of these variables and by altering the angles between the jets, the process according to the invention can be controlled so that particles of the desired shape and size distribution are obtained.

The diameter of the stream of molten metal should not be too great, but it can be varied to a certain extent without altering the particles produced, as olong as the speed and volume of the fluid jets are also altered.

The present invention is in the first place intended for use in manufacture of high-alloyed steel powder for powder-metallurgical processes. The diameter of the stream of molten metal for atomizing such steel should be in the size order of 8 mm. In order to obtain a powder of the best possible quality, the particles are suitably cooled during a free fall through a high tower, at the top of which the atomizing nozzles are placed. If the particles come into contact with a solid object before they have solidified sufficiently, they will be deformed and no longer have the desired spherical shape. The cooling of the particles may take place entirely or partially in a fluidized bed. Nitrogen or argon are suitably used as an atomizing fluid, and the particles should also be cooled in the same atmosphere in order that the produced particles should be completely free from oxide. The granules manufactured in accordance with the present process have proved to be of very high quality and comprise substantially round particles, which is of great importance when sintering the powder after compression. Rounded particles facilitate the compression and are thus beneficial to the future used of the powder. The granules manufactured according to the invention may be used, for example, in pressure sintering of powder bodies in accordance with the disclosure of the above mentioned patent.

The process and the apparatus according to the invention will be further described with reference to the accompanying drawings and the following examples. The invention is further defined in the appended claims.

Figure 1:
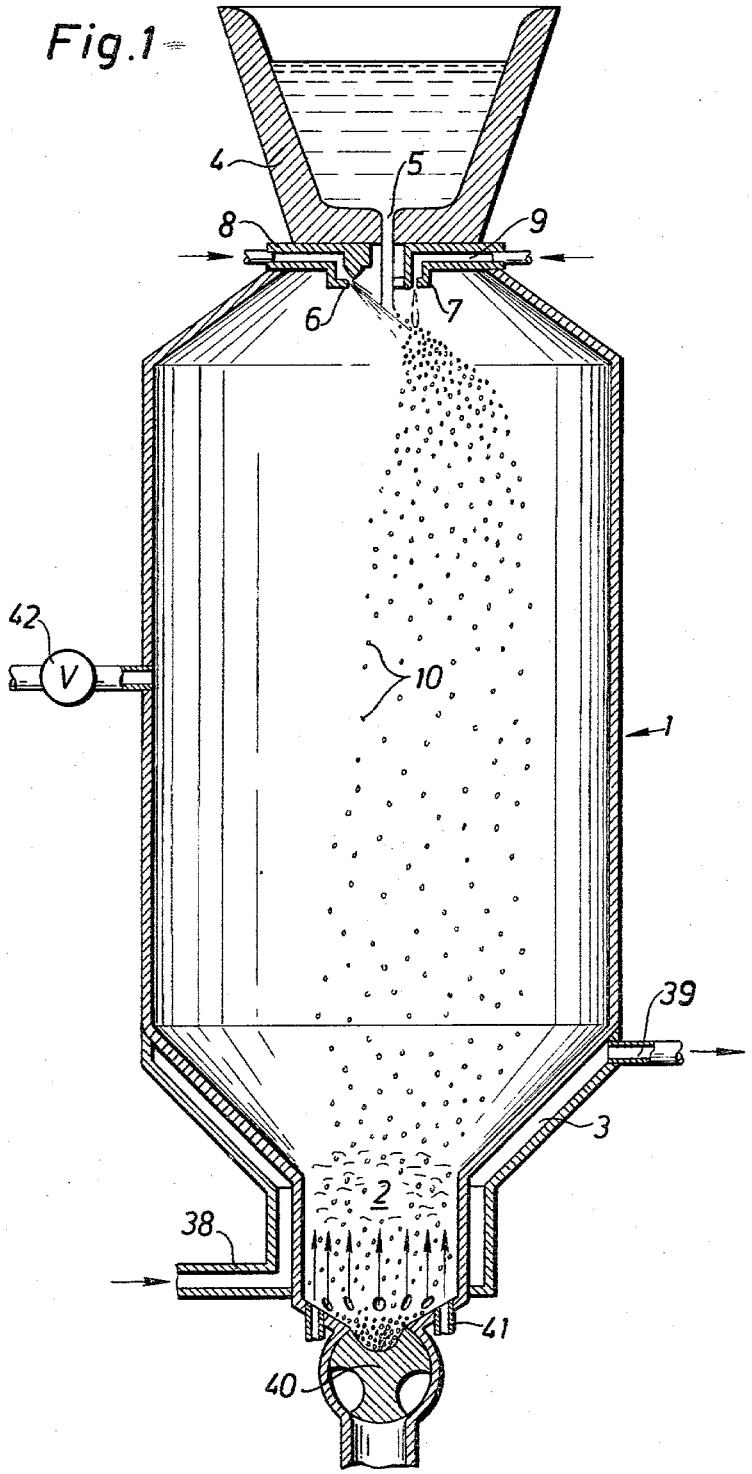
FIG. 1 shows in section an atomizing apparatus according to the present invention.

The atomizing apparatus shown in FIG. 1 comprises an atomizing chamber 1 which for example can be made of stainless steel. If the granules shall have time to cool during a free fall, the chamber must be very high. The atomizing chamber used in the specific example described below was 8 meters high. In order to lower the height of the chamber the device shown in FIG. 1 has at its lower end a fluidized bed 2 which artificially extends the time of suspension of the granules. Said fluidized bed 2 is formed by a number of argon jets introduced into the lower end of the chamber 1 through a plurality of gas inlets 41 situated annularly around the fluidized bed. Around the lower part of the chamber and around the fluidized bed 2 is a watercooled jacket 3 which is provided with a water inlet 38 and a water outlet 39. This watercooled jacket may also surround the whole granulating chamber (not shown in the figure). In order to improve the cooling conditions in the chamber 1 the latter may also be provided with internal cooling members and internal circulation of gas. During the atomizing process the chamber 1 is preferably filled with an inert gas, for example argon, which should also be used to maintain the fluidized bed so that oxidation on the surface of the particles is avoided. A gas outlet 42 for surplus gas is arranged in the wall of the chamber. The finished particles are removed below the fluidized bed through a rotary valve 40.

The atomizing means are placed at the top of the chamber 1 and consist of a tundish 4 filled with molten metal and provided with a tapping hole 5 through which a stream of molten metal flows between two fuid nozzles 6 and 7. The nozzle 6 is a straight slit nozzle of the conventional type, the design of which may be varied and may for instance be of the well-known De Laval-type. The nozzle 7, however, being the main point in the present invention, is provided with a semi-circular slit and is described below more in detail. Nozzles 6 and 7, which are supplied with high pressure nitrogen through condiuts 8 and 9 are shaped and directed in such a way that nozzle 6 directs a jet of nitrogen at an angle of substantially 45° to the metal stream so that the stream is deflected in the direction of the nitrogen jet and after that is intersected by another jet of nitrogen which is directed by nozzle 7 substantially parallel to the original direction of the metal stream. In this way the stream of molten metal is dispersed into a shower 10 of free particles or granules which are cooled on their way through chamber 1 and the fluidized bed 2.

Figure 2:
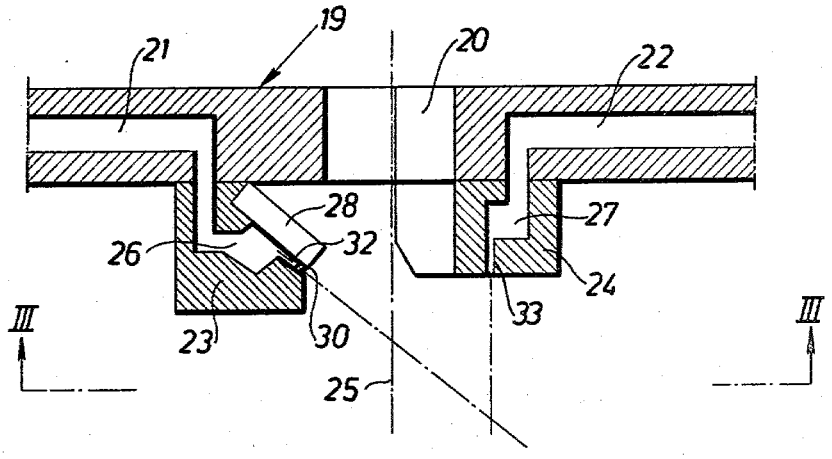
FIGS. 2 and 3 show in detail on a larger scale a cross-section and a bottom view, respectively, of the nozzle arrangement according to the present invention.
Figure 3:
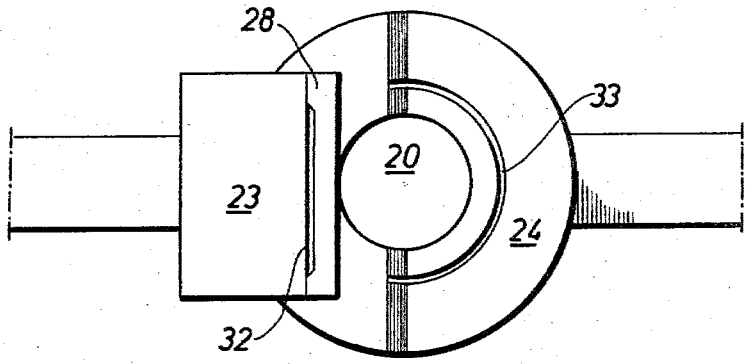

FIGS. 2 and 3 show more in detail the nozzle design for supplying the atomizing medium, in this case nitrogen, to a stream of molten metal. FIG. 2 shows part of a plate 19 which may be of steel or the like, in which there is a hole 20 for the stream of molten metal and two channels 21 and 22 for the supply of nitrogen to the nozzles 23 and 24 which are attached to the bottom side of the plate. The nozzles may be attached to the plate by welding or with bolts. Connecting channels are drilled between the channels 21 and 22 and the inside of the nozzles. The tundish is to be placed on the top side of the plate 19. In FIG. 2 the extension of the original main direction of the casting stream is indicated by a dotted line 25. The nozzle 23 has been produced by cutting a recess 26 in the edge of the nozzle. The recess 26 extends perpendicularly to the plane of the figure and is covered by covering plate 28, also extending perpendicular to the plane of the figure. Plate 28 is provided with a shallow notch 30 which, when the covering plate is fitted over the recess 26, forms a narrow slit 32 with the nozzle body. The length of the slit 32 is greater than the original diameter of the stream of molten metal. The covering plate 28 can be attached to the nozzle body with bolts, not illustrated.

The nozzle 24 is, unlike the nozzle 23, provided with a semi-circular slit 33 connected to a slit 27 cut in the edge of the nozzle. As is shown in FIG. 3, the imagined center of the semi-circular slit 33 coincides with the center line 25 of the extension of the stream of molten metal. As is also shown in FIG. 3, the nozzle 24 is positioned in relation to nozzle 23 so that an imagined line containing both ends of slit 33 is parallel with the slit 32 of nozzle 23.

The ranges defined above for the angles between the stream of molten metal and the first fluid jet and between the first and the second fluid jets are set because too large an angle between the fluid jet and the melt means that the particles are thrown back too much against the fluid nozzles, with the risk of then becoming clogged. The smaller the angle is between the tapping stream and the fluid jet, the more rapidly the melt will be pushed out of the way, and is thus prevented from being thrown back. However, if the angle is too small the particles produced will be too coarse and irregular. In principle the same reason limit the angle between the two fluid jets. The negative angles between the stream of molten metal and the second fluid jet is probably not very suitable in general since, i.a. they give rise to too great a distance between the nozzles of the fluid jets and the intersection points of the jets. In order to attain the desired well-defined and sharp fluid jets, the distance between the nozzles and the intersection points of the fluid jets must be kept as short as possible.

The following examples further illustrate the invention.

EXAMPLE

The apparatus used was substantially similar to the apparatus shown in FIG. 1, but no fluidized bed was used at the lower part of the granulating chamber. The height of the tower was 8 meters. The experiments were carried out for atomizing high-speed tool steel with a vertical tapping stream. The straight nozzle had a slit width of 0.70 mm and a length of 40 mm, whereas the slit width of the semi-circular nozzle was 0.60 mm and its diameter 67 mm. The nozzle having a straight slit was directed under an angle of 22° towards the stream of molten metal and was positioned at a distance of about 30 mm from the center line. The curved nozzle was directed parallel to the stream of molten metal and at a distance of 33.5 mm from the center line of said stream.

The circular tapping hole of the melt had a diameter of 8 mm, giving a flow rate of 45 kilograms steel per minute. Nitrogen was used as an atomizing medium. The gas pressure, measured in the supply conduit before the nozzles, was in this case 15 atms for both nozzle parts. The total quantity of consumed gas was 800 $Nm^3$ per hour.

For comparison the same test was carried out with straight slits in both nozzles. All other parameters were maintained unchanged. The grain size distribution of the powders obtained in the two tests are given in the table below. It is obvious therefrom that using a curved nozzle results in finer grains with a smaller fraction of over-sized grains. This means that if a powder of a certain grain distribution is desired, such powder can be obtained with a smaller gas consumption per weight unit of powder. The reduced amount of over-sized grains means that a smaller amount of such grains has to be sieved away. Since large drops formed by the atomization are subject to slower cooling, they adhere to the walls of the apparatus or cause adhering of the finer grains in the collecting bed. In prior methods not only the largest grains but also part of the small grains are thus removed in the screening, which all contributes to a lower yield. In view of the better and safer atomization when applying the technique of the invention this disadvantage is eliminated and the yield further improved.

The new type of nozzle has been found to operate perfectly under varying conditions. Thus, it has been found by tests that the nozzle pressures may vary between 7 and 20 atms. for the curved nozzle and between 4 and 20 atms. for the nozzle having a straight slit. The atomizing speed has been found to be variable between 20 and 70 kgs per minute without impairing the granulating result.

As already indicated, essential advantages are gained by using a curved nozzle in accordance with the present invention. The main advantage seems to be the fact that no great accuracy is required for attaching the nozzle tube to the tundish. Even if the nozzle cube is attached somewhat askew the curved form of the nozzle results in that particles are recovered which when applying conventional technique would end up next to the gas stream coming from the steam coming from the nozzle. Moreover an essentially improved yield is obtained, and in some 20 tests practically carried out the yield of final powder based on material supplied to the furnace has been about 97–98%. This is an essential improvement in relation to the prior art, where the corresponding yield lies at about 90%.

TABLE

| Passed through sieve | 1 straight + 1 curved nozzle % | 2 straight nozzles % |
|---|---|---|
| <325 mesh | 10.6 | 3.4 |
| 250 mesh | 17. | 6.4 |
| 200 mesh | 23.3 | 10.1 |
| 150 mesh | 30.1 | 17.2 |
| 100 mesh | 36.3 | 26.6 |
| 80 mesh | 41.2 | 28.5 |
| 200 μm | 64. | 39.2 |
| 250 μm | 77.8 | 48.0 |
| 315 μm | 82.8 | 55.0 |
| 400 μm | 91.6 | 68.5 |
| 500 μm | 97.0 | 77.0 |
| 630 μm | 99.9 | 87.3 |
| 800 μm | | 95.8 |
| >800 μm | | 4.1 |

What we claim is:

1. An apparatus for granulating a molten material, preferably molten metal, by disintegration of a stream of the molten material by fluid jets, directed under high pressure against said stream, comprising a casting tundish of at least one casting opening, a first slit nozzle, and a second slit nozzle, one on each side of said casting opening, the first of said nozzles being directed in relation to the center axis of the casting opening such that said nozzle and fluid jet emanating therefrom form an acute angle to said stream, wherein the improvement comprises a second nozzle, in a plane perpendicular to a pouring direction from said casting tundish, as a concave segment of a curve with the concave side of said nozzle facing the casting opening and directed essentially in the same direction as said casting opening and defining a concave segment of less than about 180°.

2. Apparatus according to claim 1, characterized in that said second nozzle is of a concave curvature facing a stream of molten metal, and perpendicular to within about ±10° of the original stream of molten metal issuing from said casting opening.

3. Apparatus according to claim 2, characterized in that the center of curvature for said nozzle substantially coincides with the center of the casting opening.

4. Apparatus according to claim 2, characterized in that said second nozzle covers a circular sector of at least about 120° to about 180°.

5. Apparatus according to claim 1, characterized in that the center plane of the first nozzle forms an angle of about 30° to 60° with the center line of the casting opening.

* * * * *